US008656891B2

(12) United States Patent
Stewart et al.

(10) Patent No.: US 8,656,891 B2
(45) Date of Patent: Feb. 25, 2014

(54) HORIZONTAL CONTROL SURFACE FOR A FUEL INJECTOR

(76) Inventors: Ted Stewart, Jacksonville, FL (US); James Napier, Atlantic Beach, FL (US)

( * ) Notice: Subject to any disclaimer, the term of this patent is extended or adjusted under 35 U.S.C. 154(b) by 1994 days.

(21) Appl. No.: 11/445,949

(22) Filed: Jun. 2, 2006

(65) Prior Publication Data

US 2007/0012297 A1 Jan. 18, 2007

Related U.S. Application Data

(63) Continuation-in-part of application No. 11/044,991, filed on Jan. 27, 2005.

(51) Int. Cl.
*F02M 37/04* (2006.01)

(52) U.S. Cl.
USPC ..... 123/500; 123/501; 123/503; 123/495; 123/683; 417/494; 417/499; 417/289

(58) Field of Classification Search
USPC ..... 123/500, 478, 501, 503, 504, 495, 123/179.17
See application file for complete search history.

(56) References Cited

U.S. PATENT DOCUMENTS

| | | | | |
|---|---|---|---|---|
| 4,327,694 | A * | 5/1982 | Henson et al. | 123/500 |
| 6,009,850 | A * | 1/2000 | DeLuca | 123/299 |
| 6,321,723 | B1 | 11/2001 | Merkle et al. | |
| 6,763,810 | B1 | 7/2004 | Jones | |
| 6,945,233 | B2 * | 9/2005 | Stewart et al. | 123/500 |

* cited by examiner

*Primary Examiner* — Lindsay Low
*Assistant Examiner* — Kevin Lathers
(74) *Attorney, Agent, or Firm* — Schmid PA

(57) ABSTRACT

Disclosed is a fuel injection mechanism having a horizontal control surface formed within a plunger for regulating the start of fuel injection. The horizontal control surfaces are formed within one or more of the two opposed ridges formed within the plunger defining a recessed channel there between. The horizontal control surfaces of the ridges regulate the opening and closing of the ports formed within the bushing of the injector. The horizontal control surfaces contribute to reduced wear and provide for accurate timing and fuel quantity delivery.

16 Claims, 6 Drawing Sheets

Figure 3: Plunger's Timing surfaces for all Notch Positions
(horizontal surfaces are located every 25 degrees from either starting position)

Figure 3: Plunger's Timing surfaces for all Notch Positions
(horizontal surfaces are located every 25 degrees from either starting position)

Figure 3: Plunger's Timing Helix Steps for all Notch Positions
(horizontal steps are located every 25 degrees from either starting position)

HORIZONTAL CONTROL SURFACE FOR A FUEL INJECTOR

CROSS-REFERENCE TO RELATED APPLICATION

This application is a continuation-in-part of U.S. application Ser. No. 11/044,991, filed Jan. 27, 2005, the contents of which are hereby incorporated in their entirety.

FIELD OF THE INVENTION

The present invention generally relates to a fuel injection system and more specifically the invention relates to horizontal control surfaces formed in the helix ridge of a fuel injector plunger for increased operational precision and reduced service wear.

BACKGROUND

Mechanical fuel injectors for both diesel and gasoline engines generally have various critical parts which can impede the operational performance of the injector and engine due to design precision and field service wear. Such fuel injectors are typically designed to be located and seated in a tapered hole in the center of a cylinder head. For the locomotive style fuel injector the upper external working parts of the injector are lubricated by oil splash that enters through a clearance around the metering rack. However, the lower internal working parts are lubricated and cooled by the flow of diesel fuel through the lower half of the injector.

One of the critical internal working injector components subject to wear is the plunger. The injector plunger is primarily responsible for the proper atomization of the fuel which is accomplished by the high pressure created during the downward stroke of the plunger. The downward stroke of the plunger forces the fuel past a check valve and out through spray holes in the injector tip via the connecting fuel passages. The plunger is placed in motion within the fuel injector by an engine cam either directly or indirectly acting through a rocker arm and injector follower which pushes the plunger. Rotation of the plunger is accomplished by a rack and gear system linked to the engine governor that controls the quantity of high pressure fuel injected into the combustion chamber during the cylinder's power stroke.

Typically, the injector plunger includes smooth helical ridges formed near each end of the plunger to control the opening and closing of the fuel ports within the injector's bushing in which the plunger operates. The continuous helical ridges mechanically determine the opening and closing of the supply and return ports of the injector's plunger bushing. Typically, two opposed helical shaped ridges are located on the plunger. The first opposed helical ridge controls the start of the injection event timing and the second opposed helical ridge ultimately controls the quantity of high pressure fuel delivered by ending the injection event. The timing control helix ridge closes the bushing's fuel supply port to start the fuel injection event and the fuel control helix then opens the bushing's fuel return port to end fuel injection event. As the two opposed helical ridges are machined or formed closer together, the gap between the two grows smaller and the fueling rate is increased such that the duration from the closing of the fuel supply port to the opening of the fuel return port is extended.

Fuel delivery to the cylinder's combustion chamber is regulated in part by the rotation of the plunger which regulates the duration that the supply and return fuel ports are closed during the downward stroke. As the plunger is rotated from the idling position to the full load position, the pumping stroke is lengthened and the distance between the two opposed helical ridges becomes less and the start of injection begins earlier in the combustion cycle which allows for more fuel to be injected. The various degrees of rotation correspond to a locomotive engine's throttle positions. Typically, one notch or throttle position corresponds to 25 degrees of rotation. For example, a notch setting of one on a typical diesel locomotive corresponds to 50 degrees rotation, a notch eight position corresponds to 225 degrees of rotation and at idle the degree of rotation is 25 degrees.

Typically, both the timing and fuel control helix ridges are machined into the plunger body as serpentine ridges continuously sloping up the side of the plunger. Thus, a sloping diagonal profile of the helix edge is presented and passed across the opening of the supply and return fuel ports during each injection cycle. Unfortunately, this sloping edge profile is unable to provide the precise control of the injection cycle's fueling duration event. Precision control is desirable in optimizing of the fuel injection timing to both control harmful engine emissions and to reduce fuel consumption. The manufacturing tolerances of a typical diesel engine injector plunger are such that the sloping edge profile of the continuously angled timing helix is unable to consistently and accurately close the bushing's fuel inlet port to initiate the start of injection.

Furthermore, the sloping edge profile of a continuously angled helix ridge is not able to accurately differentiate between notches due to worn mechanical fuel linkages. Each notch represents a set plunger rotation that presents a desired angle profile or position of the plunger to control or start the injection event. Worn mechanical linkages can cause the set rotation of each desired notch setting to deviate from its preset location such that the timing for the injection event is altered given that a different angle profile is presented on the plunger as it is rotated beyond or before its preset notch location.

Additionally, the continuously sloping edge profile and angled helical ridge promotes accelerated wear of the helix edge given the inherent sweeping motion of the plunger as it moves across the fuel supply inlet port opening. Pressurized fuel is forced up and over the helix edge as the edge profile is moved across the inlet port. This fuel movement is not uniform across the edge profile and is concentrated along the lowest sloping portion of the leading edge of the helix ridge. The concentrated fuel flow results in an uneven wear on the helix edge that may eventually alter the injection timing. The altered injection timing impedes the engine's performance since the start of injection is no longer optimized for a particular notch setting or performance characteristic.

A further disadvantage associated with the continuously angled helices or ridges is their inability to mechanically and accurately accommodate significant change in timing between adjacent notches. A significant change in timing between notches requires extreme changes in the continuously angled helix ridge as to make such accommodations almost impossible to accomplish.

Thus, what is needed is a method and apparatus capable of providing an optimized timing event that overcomes the varying manufacturing tolerances and inherent wear associated with mechanical injection timing.

SUMMARY

The present invention generally relates to a fuel injection timing and control mechanism and in particular the invention relates to a horizontal control surface of an injector plunger for regulating fuel injection timing and fuel control in a mechanical fuel injector. The horizontal control surface comprises two opposed ridges formed within the plunger. The ridges define a recessed channel formed between the two opposed ridges that encircle the axial portion of the plunger. The horizontal control surfaces or ridges regulate the opening and closing of the ports formed within the bushing of the injector. The horizontal control surface is able to reduce wear and provide for accurate timing and fuel quantity delivery.

In greater detail, the fuel injection mechanism for regulating the volume of fuel injected includes a plunger having a first and a second opposed ridge and a recessed channel positioned between and defined by the first and second opposed ridges and encircling an axial portion of the plunger. The fuel mechanism includes at least one of the opposed ridges having at least one horizontal control surface relative to the longitudinal axis of the plunger.

A plurality of horizontal control surfaces may be formed on the injector plunger, wherein the horizontal control surfaces are positioned about the longitudinal axis of the plunger and around the axial portion of the plunger such that at least two horizontal control surfaces are associated with separate locomotive throttle positions. The horizontal control surfaces are connected by a plurality riser ridge segments which may be formed from varying heights. The riser ridge segments may be formed from angles of equal slope about the longitudinal axis of the plunger.

A further embodiment includes a fuel injection mechanism for regulating the volume of fuel injected including a body housing a rotatable plunger slidably fitted within a bushing. The bushing includes a first and a second port formed within the wall of the bushing and a nozzle tip or opening for expelling the fuel. The plunger includes a first and a second opposed ridge and a recessed channel positioned between and defined by the first and second opposed ridges and encircling an axial portion of the plunger. Additionally, at least one of the opposed ridges includes a horizontal control surface relative to the longitudinal axis of the plunger. The horizontal control surface includes a length greater than an inner diameter of the port openings formed within the bushing.

An additional embodiment includes a diesel engine having a fuel system. The fuel system includes a plurality of cylinders and a plurality of fuel injection mechanisms seated in respective cylinders. The injection mechanism includes a body, a rotatable plunger slidably fitting within a bushing, and a nozzle tip. The plunger includes a first and a second opposed ridge and a recessed channel positioned between and defined by the first and second opposed ridges. The recessed channel and the ridges encircle the axial portion of the plunger. Furthermore, at least one of the opposed ridges includes a horizontal control surface relative to the longitudinal axis of the plunger.

The fuel system for the diesel engine further includes a rack and governor constructed and arranged to control rotation of the plunger. A fuel supply line is connected to the injection mechanisms to supply fuel and a fuel return line is included in the fuel system to return unused fuel to a fuel supply tank. The injection mechanism may further include a fuel injection pump with the plunger being positioned in the fuel injection pump. Typically, the diesel engine is mounted in a locomotive and the injection mechanism is a fuel injector.

DRAWINGS

DETAILED DESCRIPTION

Disclosed is a fuel injection mechanism for regulating the start of injection and the total volume of fuel injected into a cylinder. The fuel injection mechanism includes horizontal control surfaces formed from opposed edges defining a recessed fuel channel within the plunger. The opposed edges of the plunger provide the horizontal control surfaces that regulate the opening and closing of the supply and return fuel ports formed within the bushing of the fuel injector. The positioning of the horizontal control surfaces about the longitudinal axis of the plunger determines the timing or duration of the injection process and the quantity of fuel delivered.

In greater detail, the advantages of the present horizontal control helices are set forth below. The horizontal control surfaces of the present injection mechanism are configured to consistently close the bushing's fuel inlet port to accurately initiate the start of injection, regardless of the port inlet opening's manufacturing tolerances which may be as great as 0.030 to 0.040 inches. Additionally, the horizontal control surface prevents accelerated or premature wear from occurring to the helix edge by forcing the fuel down and away from the helix edge. Thus, the horizontal control surface is able to maintain the correct start of injection with a clean horizontal cutting motion across the inlet port opening to allow for longer service life.

Furthermore, the horizontal control surfaces are able to provide a greater flexibility of design over conventional continuously angled helices. The horizontal control surfaces can accommodate most any change that may be required between adjacent notch positions as opposed to a continuously angled timing helix which cannot accurately accommodate dramatic changes in timing between adjacent notches because of the extreme angles that would be present. The ability to accommodate such drastic changes provides for the ability to custom design a plunger's horizontal control surfaces to optimize an injector performance for either optimum fuel consumption or a specified emissions reduction limit.

Referring now in greater detail to the drawings in which like numerals indicate like parts throughout the several views, FIGS. 1-6 depict the horizontal control surfaces in various embodiments of the present invention.

Figure 1:
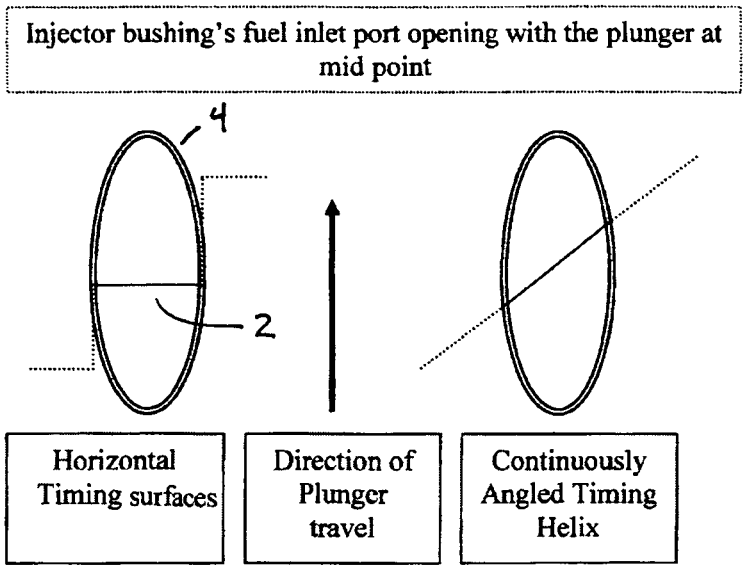
FIG. 1 illustrates an embodiment of the present horizontal control surface and the prior art continuously angled helix in the bushing's fuel inlet supply port opening with the plunger at mid point.

As indicated in FIG. 1, the horizontal control surface 2 is depicted as passing over the fuel supply port 4 formed within the bushing 14 of the fuel injector 16. The arrow depicts the travel of the plunger 12 and the horizontal control surface 2. The horizontal control surface 2 may be sized so as to encompass the diagonal cross section of the port 4 at its mid center as shown in FIG. 1 or in an alternative embodiment the horizontal control surface 2 may be sized as to extend beyond the diagonal cross section of the port 4 at its mid center to further compensate the varying mechanical tolerances of the injector bushing. The horizontal control surface 2 presents a control surface formed from a ridge within the plunger 12 that is substantially horizontal to the direction of the plunger 12 travel as is shown in FIG. 1.

Additionally, FIG. 1 illustrates the prior art continuously angled control surface as it passes over the fuel port formed within the bushing of the fuel injector. The angled control surface dissects the fuel inlet port such that the angled control surface creates angles of differing degrees at the intersection point of the angled control surface and the wall edge of the fuel inlet port. As illustrated in FIG. 1, the angle created at the lower section of the port is smaller than that created at the top portion. The smaller angled intersection receives greater wear as the fuel is forced to flow over the control edge at a greater velocity than that of the larger angled intersection.

Figure 2:
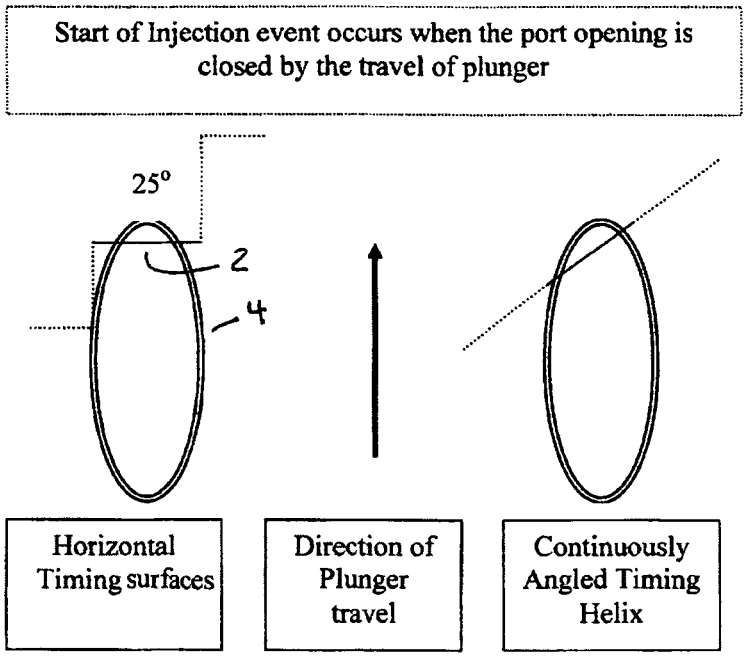
FIG. 2 depicts an embodiment of the present horizontal control surface and the prior art angled helix at the start of injection when the fuel inlet supply port opening is closed by the travel of the plunger.

FIG. 2 depicts the horizontal control surface 2 passing over the fuel port 4 formed within the bushing 14 of the fuel injector 16 at the upper portion of the port 4. The horizontal control surface 2 is shown in a position wherein the start of injection is about to occur as the horizontal control surface 2 closes the port 4. Once the port 4 is closed, the injection event will begin. As shown in FIG. 2, the horizontal control surface 2 presents a profile that extends beyond the outer walls of the port 4. Thus, as the mechanical linkages wear and the rotation of the plunger 12 is no longer exact, the horizontal control surface 2 is able to compensate for rotational variances.

FIG. 2 further depicts the prior art angled control surface passing over the fuel port formed within the bushing as the start of injection is about to occur. As shown in FIG. 2, the continuously angled control surface is not able to compensate for rotational variances. For example, if the plunger were to be rotated less than 25 degrees the injection event for the angled control surface would occur prematurely. Rotations beyond the standard 25 degrees of rotation result in the injection event occurring later than desired for the notch setting.

Figure 3:
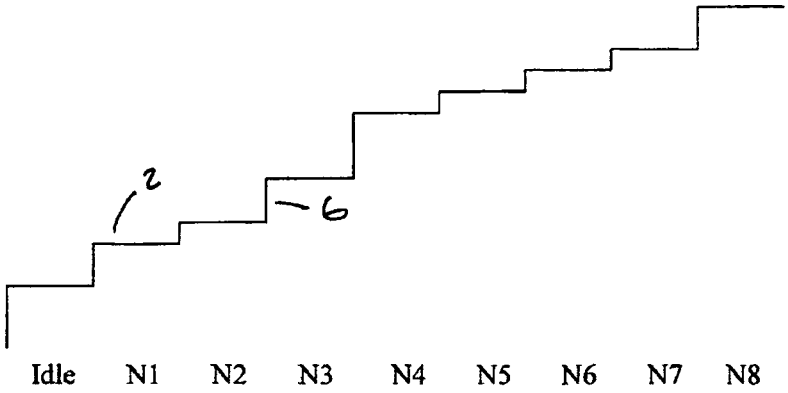
FIG. 3 illustrates a linear profile of the horizontal control surfaces in their relative positions about the plunger circumference at the related notch positions.

Referring now to FIG. 3, there is illustrated the horizontal control surfaces 2 formed from opposed ridges of the plunger 12 and their relative positions progressing along the longitudinal axis of the plunger 12. The horizontal control surfaces 2 may be positioned about the axial portion of the plunger 12 at positions that represent a 25 degree turn of the plunger 12 from a starting position. Typically, the 25 degree turns are equivalent to notch positions or throttle positions of an engine. As depicted in FIG. 3, the horizontal control surfaces 2 are shown as having a rise 6 perpendicular to the longitudinal axis 30 of the plunger 12 and a run or horizontal control surface 2 that is horizontal to the longitudinal axis 30 of the plunger 12. As shown, the rise 6 portion of ridge 8(*a-b*) may have varying lengths depending upon the desired optimization of the fuel injector 32. For example, in the application of the timing ridge 8*a* or timing helix the height of the rise 6 portion of the timing ridge 8*a* may be adjusted to either advance or retard the timing depending upon if fuel savings or emissions reduction desired. The run portion or horizontal control surface 2 may also be varied or as depicted in FIG. 3 remain the same though out the ridge 8(*a-b*).

Figure 4:
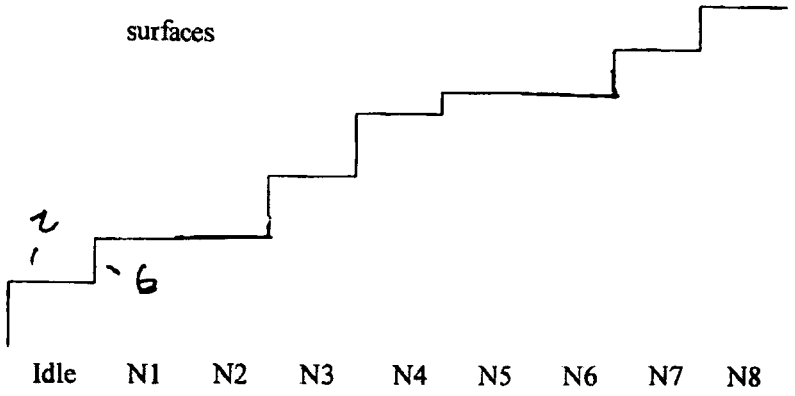
FIG. 4 depicts a linear profile of the horizontal control surfaces, wherein an individual horizontal control surface is designated for at least two notch positions.

FIG. 4 depicts an embodiment of the horizontal control surface 2 extending beyond more than one notch setting such that one horizontal control surface 2 will be the same for two separate 25 degree rotations of the plunger 12 or notch settings. The embodiment of FIG. 4 may be preferred for instances where the rise 6 portion of the ridge 8(*a-b*) is not significant or for when various notch settings are rarely used.

Figure 5:
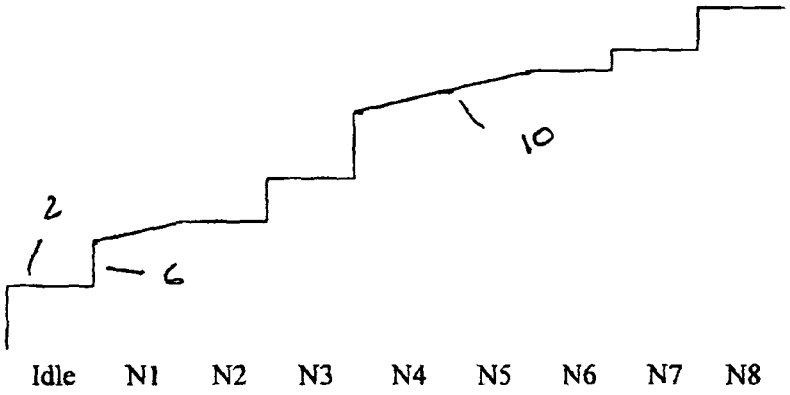
FIG. 5 illustrates a linear profile of an embodiment of the horizontal control surfaces, wherein the horizontal control surfaces are connected by sloping control surfaces in the notch positions.

Referring to FIG. 5, there is depicted an embodiment wherein the horizontal control surfaces 2 are combined with angled control surfaces 10. The rise 6 portion of the ridge 8(*a-b*) may be formed from an angled control surface 10 for certain notch settings in use in combination with horizontal control surfaces 2. The embodiment of FIG. 5 may be preferred for the reasons similar to that embodied in FIG. 4. For example, precision between seldom used notches may not be desired or when one does not desire to customize various notch settings that are seldom used for a particular engine application.

Figure 6:
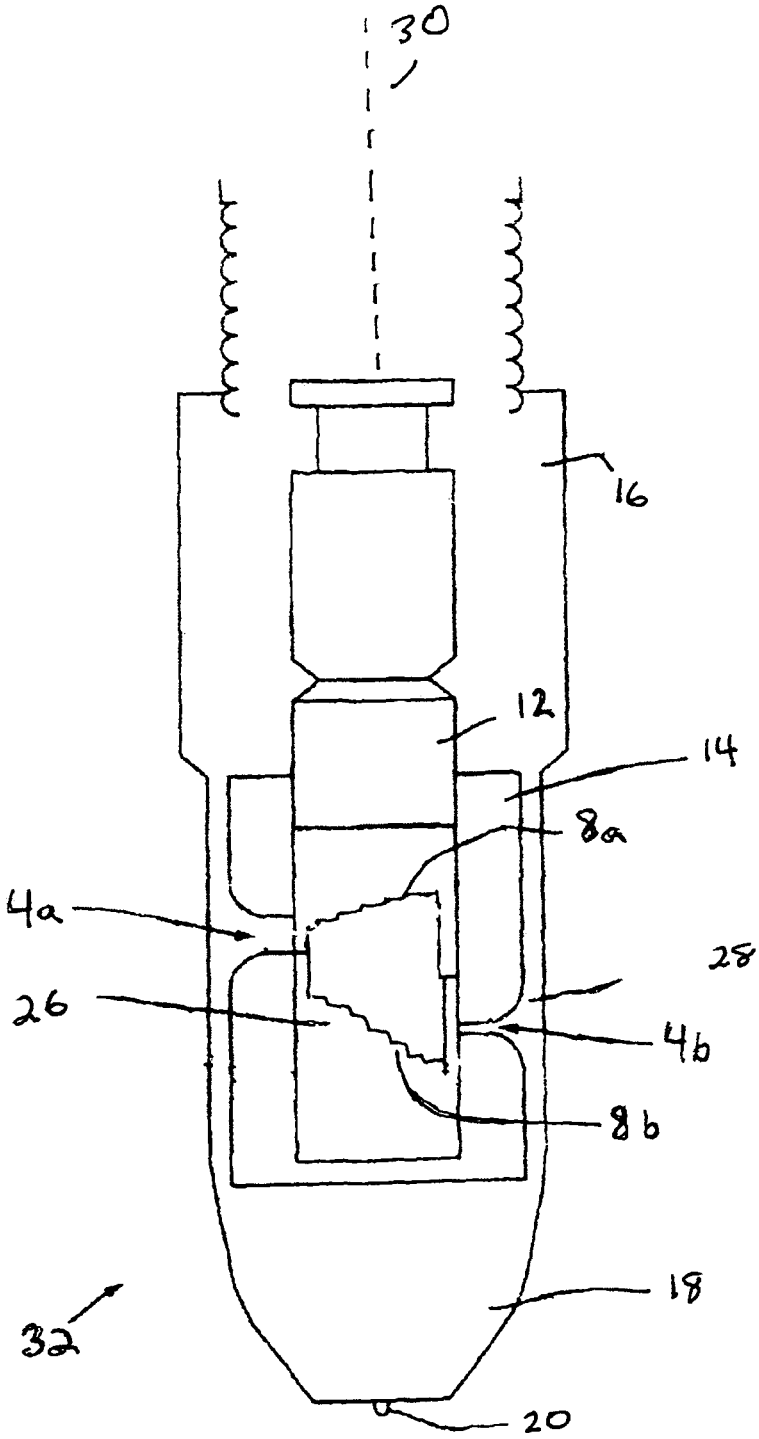
FIG. 6 is a partial cutaway view of a fuel injector illustrating the horizontal control surfaces.

FIG. 6 is a partial cutaway cross-sectional view of a fuel injector 32 according to an embodiment. The fuel injector 32 may be an injector for a fuel system of an engine, such as a diesel engine manufactured by GM EMD (General Motors Electro-Motive Division). EMD-type engines employ mechanical control of injection timing and may be implemented effectively in various settings. For example, locomotive (line-haul, switcher, passenger, or road), marine propulsion, offshore- and land-based oil well drilling rigs, stationary electric power generation, nuclear power generating plants, and pipeline and dredge pump applications. In one embodiment, injector 32 is implemented in an EMD 567, 645, or 710 series engine.

FIG. 6 depicts a mechanical unit injector and associated plunger for EMD-type locomotive engines. However, horizontal control surfaces 2 may be similarly applied to engines that employ fuel injection pumps, such as diesel engines manufactured by General Electric (GE) Transportation Systems, including the GE 7FDL and 7HDL engines, and diesel engines manufactured by American Locomotive Company (ALCO). In such engines, each fuel injection pump includes a similar plunger that supplies high pressure fuel to an injector via a high-pressure fuel line.

The fuel injector 32 includes a body 16, a plunger 12, a housing nut 28, a bushing 14, a nozzle tip 18, and spray holes 20. Other components of injector 32 are not shown in FIG. 6 and are known in the art. The fuel injector 32 is generally located and seated in a hole of a cylinder head of an engine fuel system or cylinder assembly system. Plunger 12 slidably fits within bushing 14. The bushing 14 includes an upper port 4*a* or fuel inlet port 4*a* and a lower port 4*b* or fuel return port 4*b*. The upper fuel inlet port 4*a* and lower fuel return port 4*b* are pathways for fuel. The amount of fuel injected into a cylinder depends on the extent to which the ports are closed during the downward plunger stroke.

The specific form of plunger 12, including diameter, roundness, and straightness thereof, may vary depending on the implementation. Diameters of plungers may vary depending on the amount of fuel that is needed for injection. For example, the plunger 12 may have a diameter of between about 8 and 22 mm. Materials for the plunger 12 may be chosen to prevent the plunger 12 from substantial wear, thus to prevent performance of the plunger 12 from being degraded. The plunger 12 may be formed of bearing quality or high alloy steel, such as a chromium/nickel alloy. By way of example, the steel may conform to the 51501 or 52100 specifications of the Society of Automotive Engineers (SAE).

As depicted in FIG. 6, the plunger 12 includes an upper or first ridge 8*a* and a lower ridge or second ridge 8*b*. The upper ridge 8*a* and lower ridge 8*b* determine the opening and closing of upper port 4*a* and lower port 4*b* of bushing 14. The upper ridge 8*a* determines when injection starts, and the lower ridge 8*b* helps determine when injection ends. Thus, in combination with the upper ridge 8*a*, the lower ridge 8*b* determines the volume of fuel that is injected.

The upper ridge 8*a* and the lower ridge define 8*b* a shallow recessed fuel channel 26 encircling an axial portion of plunger 12. Both the upper 8*a* and lower ridge 8*b* may contain the horizontal control surfaces 2 previously described. In one embodiment, only the upper ridge 8*a* is comprised of horizontal control surfaces. A further embodiment includes both the upper ridge 8*a* and the lower ridge 8*b* including horizontal control surfaces 2. A further embodiment contemplates only the lower ridge 8*b* including horizontal control surfaces 2.

The plunger 12 may be given a constant stroke reciprocating motion by an injector cam lobe acting through a rocker arm and injector follower (not shown). An adjusting screw (not shown) at the end of the rocker arm may be used to set the static timing of the injection period during the plunger stroke. The plunger 12 may be rotated via a rack and gear (not shown), as known in the art. Rotation of the plunger 12 regulates the time that the upper port 4*a* and the lower port 4*b* may open and close during the downward plunger stroke, thus determining the quantity of fuel injected into the combustion chamber. As plunger 12 is rotated from the idle throttle position to full throttle position, the pumping part of the stroke is lengthened, injection may be started earlier, and more fuel is injected.

Proper atomization of fuel is accomplished by the high pressure created during the downward stroke of plunger 12, which forces fuel past a needle valve (not shown), causing the needle valve to lift, thus forcing fuel out through spray holes 20 in nozzle spray tip 18 of injector 32.

While Applicants have set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

The invention claimed is:

1. A fuel injection mechanism for regulating the volume of fuel injected comprising:

a plunger having a first and a second opposed ridge;

a recessed channel positioned between and defined by the first and second opposed ridges and encircling an axial portion of the plunger; and the opposed ridges having a plurality of horizontal control surfaces, wherein the horizontal control surfaces are positioned about the longitudinal axis of the plunger and around the axial portion of the plunger such that the horizontal control surfaces being associated with separate throttle positions, the horizontal control surfaces of the first opposed ridge are associated with the separate throttle positions and the horizontal control surfaces of the second opposed ridge are associated with the separate throttle positions.

2. The fuel injection mechanism of claim 1, wherein the horizontal control surfaces are connected by a plurality of riser ridge segments.

3. The fuel injection mechanism of claim 2, wherein the riser ridge segments each having angles of equal slope about the longitudinal axis of the plunger.

4. The fuel injection mechanism of claim 1, wherein the horizontal control surface having a length greater than a diameter of a port formed in a fuel injector bushing.

5. The fuel injection mechanism of claim 1, wherein the horizontal control surface on the first ridge is associated with timing of the fuel injection.

6. The fuel injection mechanism of claim 1, wherein the horizontal control surface of the second ridge is associated with the fueling rate of the injection mechanism.

7. A fuel injection mechanism for regulating the volume of fuel injected comprising:

a body wherein the body housing a rotatable plunger slidably fitting within a bushing;

a first and a second port opening formed within the bushing and a nozzle tip;

the plunger includes a first and a second opposed ridge and a recessed channel positioned there between and defined by the first and second opposed ridges and encircling an axial portion of the plunger;

the first port is operatively aligned with the first opposed ridge for regulating the timing of the fuel injection and the second port is operatively aligned with the second opposed ridge for regulating the fueling rate of the fuel injection; and the first opposed ridge including a plurality of horizontal control surfaces, wherein the horizontal control surfaces are positioned about the longitudinal axis of the plunger and around the axial portion of the plunger such that at one of the horizontal control surfaces being associated with at least two separate throttle positions.

8. The fuel injection mechanism of claim 7, wherein the horizontal control surfaces are connected by a plurality riser ridge segments, and wherein the riser ridge segments each having angles of equal slope about the longitudinal axis of the plunger.

9. The fuel injection mechanism of claim 7, wherein the horizontal control surface having a length greater than a diameter of the ports formed in the bushing.

10. A diesel engine, comprising:

a fuel system, the fuel system including, a plurality of cylinders;

a plurality of fuel injection mechanisms seated in respective cylinders, each injection mechanism including a body, a rotatable plunger slidably fitting within a bushing, and a nozzle tip;

the plunger includes a first and a second opposed ridge and a recessed channel positioned there between and defined by the first and second opposed ridges and encircling an axial portion of the plunger;

a first port is operatively aligned with the first opposed ridge for regulating the timing of the fuel injection and a second port is operatively aligned with the second opposed ridge for regulating the fueling rate of the fuel injection; and the first opposed ridge including a plurality of horizontal control surfaces, wherein the horizontal control surfaces are positioned about the longitudinal axis of the plunger and around the axial portion of the plunger such that at least one of the horizontal control surfaces being associated with at least two separate throttle positions;

a rack and governor constructed and arranged to control rotation of the plunger;

a fuel supply line to supply fuel to the injection mechanisms; and a fuel return line to return fuel to a fuel supply tank cooperating with the engine.

11. The diesel engine of claim 10, further including a plurality of horizontal control surfaces, wherein the horizontal control surfaces are positioned about the longitudinal axis of the plunger and around the axial portion of the plunger such that at least two horizontal control surfaces being associated with separate throttle positions.

12. The diesel engine of claim 10, wherein the horizontal control surfaces are connected by a plurality riser ridge segments, and wherein the riser ridge segments each having angles of equal slope about the longitudinal axis of the plunger.

13. The diesel engine of claim 10, wherein the horizontal control surface having a length greater than a diameter of the ports formed in the bushing.

14. The diesel engine of claim 10, wherein the diesel engine is mounted in a locomotive.

15. The diesel engine of claim 10, wherein the injection mechanism is a fuel injector.

16. The diesel engine of claim 10, wherein the injection mechanism includes a fuel injection pump, the plunger being positioned in the fuel injection pump.

* * * * *